United States Patent [19]

Fix

[11] Patent Number: 4,479,320

[45] Date of Patent: Oct. 30, 1984

[54] CYLINDER LOCK FOR REVOLVERS

[76] Inventor: Wilbur L. Fix, 0258 Comanchero Trail, New Castle, Colo. 81647

[21] Appl. No.: 427,964

[22] Filed: Sep. 29, 1982

[51] Int. Cl.[3] ..... F41C 27/00

[52] U.S. Cl. ..... 42/1 LP

[58] Field of Search ..... 42/1 LP

[56] References Cited

U.S. PATENT DOCUMENTS

| | | | |
|---|---|---|---|
| 3,360,880 | 1/1968 | Finnegan | 42/1 LP |
| 4,023,294 | 5/1977 | Knopp | 42/1 LP |
| 4,224,753 | 9/1980 | Bielman | 42/1 LP |

*Primary Examiner*—Charles T. Jordan

*Attorney, Agent, or Firm*—Edwin L. Spangler, Jr.

[57] ABSTRACT

This invention relates to an improved lock for revolver cylinders of the type that releasably locks the latter against rotation by passing a rod from the barrel into one of its chambers, such improvement being characterized by a loose-fitting lock rod of a length greater than that of the cylinder but shorter than the combined lengths of the latter and the barrel, a friction-held keeper for insertion into the barrel ahead of the lock rod for the purpose of keeping it in place, and an extractor capable of being connected to the keeper upon insertion into the barrel for purposes of retrieving it preparatory to removing the lock rod. The extractor includes as a part thereof a normally recessed indicator attached to the front end of a probe which projects out the rear end and through an axial opening in the keeper to where it engages the front end of the lock rod so as to extend the indicator and thus provide the user with visual confirmation that the lock rod is fully seated in the cylinder.

10 Claims, 5 Drawing Figures

CYLINDER LOCK FOR REVOLVERS

Protective devices to prevent the accidental, or in some instances the intentional, discharge of a loaded firearm are quite old in the art. One of the more common of such devices merely fastens to the trigger guard and produces a stop behind the trigger that prevents the latter from being actuated so as to release the hammer. While reliable, units of this type more often than not need to be tailored to a particular weapon because the design of the trigger assembly differs so widely from one to another.

Among the various types of pistols, revolvers are especially easy to disable since all that is needed is some mechanism to prevent the cylinder from turning as the trigger is actuated to cock the hammer, retract the firing pin and bring the cartridge in the next chamber into alignment with the barrel. In other words, if the cylinder is kept from turning, none of the above described operations can take place.

Among the prior art efforts known to applicant for disabling the cylinder of a revolver are those exemplified by U.S. Pat. Nos. 2,327,334; 2,479,107; 2,887,807; 3,368,297; and 4,023,294. Of the foregoing, the first four all employ key locks to hold the lock rod in the barrel and cylinder. If the key is lost or misplaced, of course, the revolver cannot be restored to an operative condition. More important, however, is the fact that if the lock rod is not long enough to reach at least part way into a chamber of the cylinder, the weapon can still be fired. Moreover, to do so would undoubtedly result in serious injury since the lock rod would remain as an obstruction in the barrel. Admittedly, an observer can readily ascertain from a visual examination of the weapon that it has been equipped with some sort of an accessory and, for this reason, it probably should not be fired. Unfortunately, it is usually not the adult observer who can recognize such a situation that is the reason for disabling the weapon in the first place, but rather, the child or other person totally ignorant of firearms. Accordingly, these prior art cylinder locks constitute a hazard if, perchance, they are used with the wrong weapon specifically, a revolver with a barrel a couple of inches longer than the lock rod.

By far the most pertinent prior art patent is that of Knopp U.S. Pat. No. 4,023,294. He, unlike the others, uses no lock. Instead, he uses an externally-ribbed plastic rod that is held frictionally inside the barrel so as to extend part way into one of the cartridge chambers in the cylinder. The muzzle end of the lock rod is recessed and, therefore, there is no external visual evidence of the fact that the revolver is incapable of being fired. Mutually interengageable ends on a retrieving tool and the rod enable the latter to be recovered.

Once again, however, we have the problem of the lock rod, perhaps, being too short to reach all the way back into one of the cartridge chambers in the cylinder. Obviously, if it doesn't, the weapon can still be fired and as was the situation before, with the barrel obstructed. In the latter instance, on the other hand, the situation is more serious since, with the retrieving tool disconnected, there is no external indication whatsover that the weapon is anything but ready to fire and, more important, it won't fall out of its own accord.

Applicant has now discovered that these and other shortcomings of the prior art revolver cylinder locks can be overcome by, first of all, making the lock rod a loose-fitting one which, when not kept in place by a frictional plug or "keeper", will fall out as the barrel is tilted down to place cartridges in the chambers of the cylinder. In addition, and more important, is the inclusion of an indicator on the tool used to both insert and retrieve the keeper that extends all the way through an axial opening in the latter and into a position of engagement with the lock rod such that it provides the user with a visual indication that the lock rod is seated in its proper cylinder-disabling position. Also, with both the lock rod and its keeper in place and the extractor removed, there is no visible indication that the firearm is disabled so as to interfere with the aesthetic aspects of a weapon on display.

It is, therefore, the principal object of the present invention to provide a novel and improved cylinder lock for revolvers.

A second objective is to provide a device of the type aforementioned that requires no lock or key yet is very difficult to remove without a special extracting tool assuming one is even aware of its use.

Another object is the provision of a revolver lock that is readily and inexpensively adaptable to different barrel lengths of the same caliber revolver by merely cutting the lock rod to the proper size.

Still another objective of the invention herein disclosed and claimed is to provide a fully functional cylinder lock which in no way detracts from the aesthetic appearance of the firearm when in use.

An additional object is to provide means for locking a revolver cylinder against rotation which, with the keeper removed, will fall out of the barrel thus removing the obstruction therefrom when the barrel is tilted down in the normal act of loading cartridges into the chambers of the cylinder.

Further objects are to provide a cylinder lock which is simple, versatile, easy to use, reliable, lightweight, compact, rugged and even somewhat decorative.

Other objects will be in part apparent and in part pointed out specifically hereinafter in connection with the description of the drawings that follows, and in which.

Figure 1:
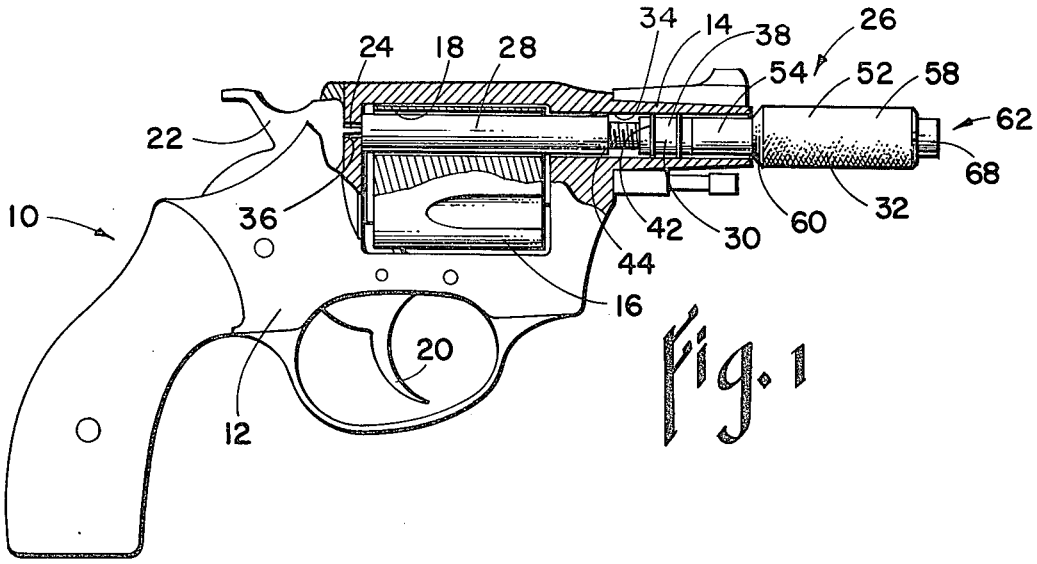
FIG. 1 is a side elevation of a revolver, portions of which have been broken away and shown in section to better reveal the lock rod, keeper and extractor that comprise the three elements of the cylinder lock.
Figure 2:
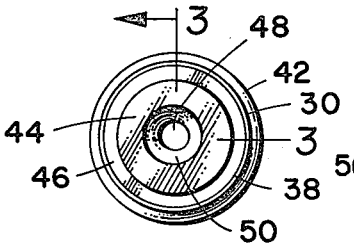
FIG. 2 is an end view to an enlarged scale of the keeper.
Figure 3:
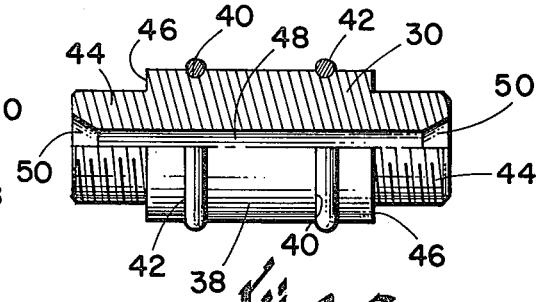
FIG. 3 is a section taken along line 3—3 of FIG. 2.
Figure 4:
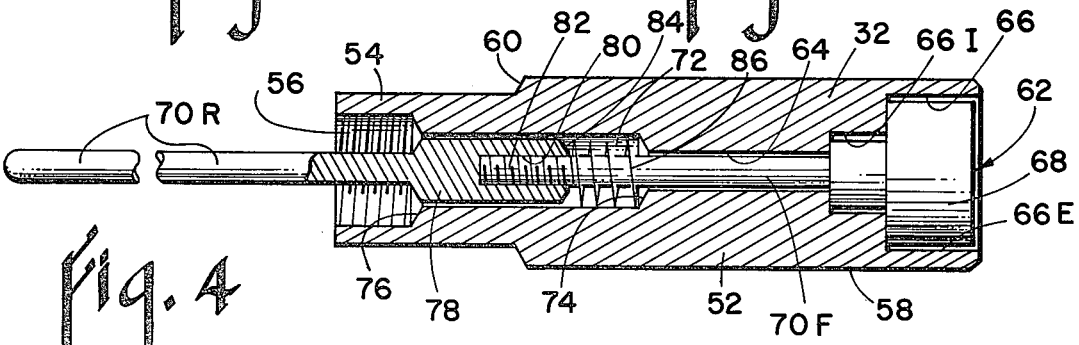
Figure 5:
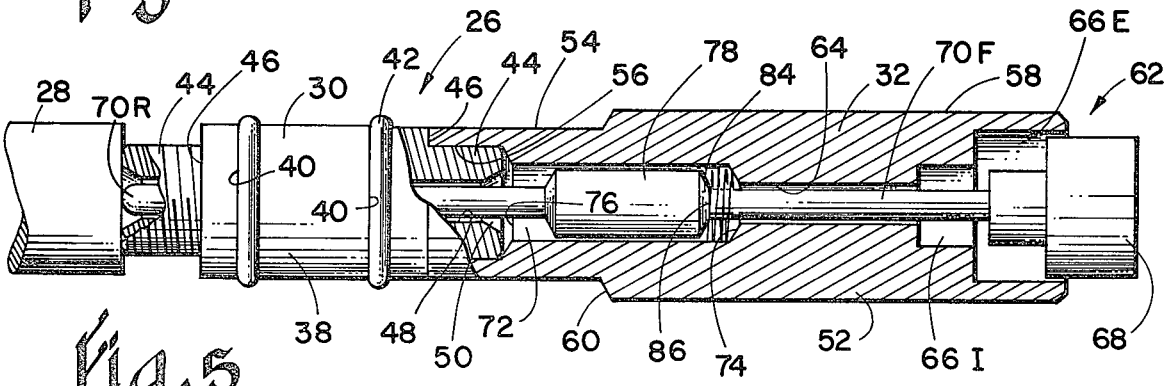

FIG. 4 is a side elevation of the extractor to the same scale as FIGS. 2 and 3, portions thereof having been broken away to conserve space while other portions have been shown in diametrical section to more clearly reveal the interior construction; and, FIG. 5 is a side elevation to the same scale as FIGS. 2–4, showing the keeper and extractor in assembled relation and with the indicator in the latter actuated into extended position due to its engagement with the lock rod with the latter seated as shown in FIG. 1 against the revolver frame behind the cylinder.

Referring next to the drawings for a detailed description of the present invention and, initially, to FIG. 1 for this purpose, reference numeral 10 has been selected to broadly designate a conventional revolver of the type having a frame 12 terminating at its front end in a barrel 14. Immediately in back of the barrel is the cylinder 16 containing a plurality of chambers 18 sequentially alignable with the barrel upon actuation of the trigger 20. As the trigger is pulled, of course, the hammer 22 retracts along with the firing pin 24 attached thereto and the cylinder rotates into a new position carrying a cartridge (not shown) therein into alignment with the barrel and with the firing pin as the hammer is released by the trigger mechanism to spring forward and fire the cartridge. As previously noted, a revolver cannot be fired unless the cylinder 16 can rotate in accordance with the aforementioned firing sequence; therefore, by locking the cylinder against rotation with respect to the barrel, the weapon is disabled.

The lock mechanism forming the subject matter of the present invention which is used for this purpose has been broadly designated by reference numberal 26 in FIGS. 1 and 5 and it will be seen to comprise a lock rod 28, a keeper 30 and an extractor 32. Lock rod 28 comprises simply a loose-fitting rod, preferably made of some soft metal like brass, copper or aluminum that wll not scratch or otherwise mar the rifling (not shown) within the bore 34 of the barrel. The loose fit is an essential element of the lock assembly since rod 28 must be free to fall out of the cylinder 16 and barrel 14 when the revolver is tilted forward to load same if, perchance, the keeper 30 is not present in the bore to hold it in place. Lengthwise, lock rod 28 must be longer than cylinder 16 so as to extend all the way from a seated position back against the frame 12 where the firing pin opening 36 opens into the cartridge chambers 18, all the way through cylinder 16 and well forward into the barrel 14 as shown in FIG. 1. In this position, the cylinder is disabled against rotation and the weapon cannot be fired as, of course, was true with the prior art cylinder locks already described.

Now, with special reference to FIGS. 2 and 3, the keeper 30 will be seen to comprise a plug having a body portion 38 of somewhat smaller diameter than that of the barrel bore 34. Encircling the body 38 at longitudinally spaced points are a pair of annular grooves 40 in each of which is seated an O-ring 42 made of rubber or some such compressible elastomeric material. The outside diameter of O-rings 42 is slightly greater than the diameter of the bore so that the keeper will be held in the latter frictionally. Opposite ends of the keeper are both provided with externally-threaded male projections 44 of reduced diameter separated from the main body by annular shoulders 46. The remaining feature of the keeper which has yet to be described is its axial bore 48 preferably terminating at both ends in a flared entryway 50.

As will be explained in greater detail presently, the combined overall length of the keeper 30 and the lock rod 28 is less than the combined lengths of the barrel 14 and cylinder 16 so that the aforementioned elements of the cylinder lock assembly 26 will, at all times, remain hidden from view when placed as shown in FIG. 1 so as to not interfere with the aesthetics of the firearm. The keeper along, on the other hand, is shorter than the cylinder so that, if necessary, it can be pushed on back into the cylinder and retrieved. Another reason, of course, is that unauthorized persons, particularly children will not be able to fire the weapon while, at the same time, remaining ignorant of just why it won't fire in case they should wish to restore same to an operative condition. In other words, with the prior art cylinder locks, all but Knopp's being visible, anyone wishing to fire the weapon is immediately aware of why it won't fire and, therefore, is in a position to take whatever steps they can think of to remove the impediment.

The function of the keeper as has been stated is that of keeping the lock rod in place, preferably seated against the frame behind the cylinder or perhaps that portion of the firing pin projecting through the firing pin opening into the cylinder. The reason this is important is because, conceivably, the keeper in combination with a short lock rod not designed for the particular barrel length could be used in such a way that both would be housed totally in the barrel forwardly of the cylinder which means, of course, that the weapon could be loaded and fired with the barrel thus obstructed. This rare, but nonetheless real, possibility has led applicant to design an extractor 32 for retrieving the keeper that provides the user with a positive visual confirmation that the aforementioned dangerous condition does not exist.

Referring to FIG. 4, the extractor 32 will be seen to include a body 52 having a necked down portion 54 at one end sized for easy insertion into the barrel. In the particular form illustrated, the necked down portion is cylindrical and the same outside diameter as that of the keeper body 38. Inside necked down portion 54 is an internally-threaded socket 56 sized to screw onto either of the externally-threaded male projections 44 on the ends of the keeper depending upon which of the two is proximal thereto.

The body 52 of the extractor also includes a handle 58 which is oversize with respect to the bore 34 and separated from the necked down portion 54 by a stop-forming shoulder 60. This shoulder engages the muzzle of the barrel 14 and, in so doing, limits the degree of penetration of the extractor.

Up to this point, extractor 32 is functionally no different than Knopps key member 20 which is designed to enter the muzzle of the revolver and screw onto his lock rod 15 for the purposes of extracting same. In the present instance, of course, the extractor engages the keeper 30 which, once removed, permits the lock rod 28 to fall out. Applicant has, however, improved considerably upon the extractor as conceived by Knopp by providing same with an indicator subassembly which has been broadly designated by reference numeral 62 and which will now be described in detail in connection with FIGS. 1, 4 and 5.

Body 52 of the extractor contains an axial bore 64 opening onto socket 56 at one end and into a recess 66 in the handle 58 at the other. Recess 66, in the particular form shown, is both cylindrical and stepped down to produce an interior section 66I of lesser diameter than the exterior section 66E. This stepped cylindrical recess is designed solely to house a similarly shaped head 68 on the handle end of indicator rod 70 housed within the axial bore and, of course, other shapes of the head and correspondingly shaped recesses therefor could be used. Between the narrowest part of bore 64 and internally-threaded socket 56 lies an intermediate sized cylindrical cavity 72 separated fom the latter by annular shoulders 74 and 76, respectively, seen in FIGS. 4 and 5.

In these same figures, it can be seen that indicator rod 70 is formed in two threadedly interconnected section 70F and 70R. As shown, section 70R that projects rearwardly through socket 56 and back into the barrel carries on its front end a cylindrical enlargement 78 which contains an internally-threaded female socket 80 (FIG. 4) that screws onto the externally-threaded male end 82 of front rod section 70F. Enlargement 78 provides a forwardly-facing shoulder 84 which cooperates with rearwardly-facing abutment 74 at the front end of intermediate size cavity 72 to confine opposite ends of compression spring 86 encircling that portion of front rod section 70F exposed within the latter cavity. The function of spring 86 is, obviously, one of normally biasing the indicator subassembly 62 rearwardly into the position shown in FIG. 4 where head 68 on the front end thereof is housed, and in a sense hidden, within recess 66 in the handle. Making the indicator rod in two pieces is, of course, necessary in order to assemble same within the extractor bore, spring 86 being placed over the rear end of front rod section 70F while the latter projects into cavity 72 preparatory to screwing rear rod section 70R on to the front section.

In order to describe how indicator subassembly 62 works and its function, reference will be made to FIGS. 1 and 5 in connection with which both the proper as well as the improper use of the cylinder lock 26 can best be set forth. The first step in disabling the revolver 10 is always one of checking the cylinder 16 to see that none of the chambers 18 is loaded and, if they are, to remove any cartridges therefrom. Next, while holding the muzzle in an elevated position, the lock rod 28 is dropped into the barrel. It makes no difference which end is inserted first since both ends are alike.

If the keeper 30 has not already been screwed into socket 56 in the rear end of the extractor 32, then this is the next step whereupon, by taking ahold of the handle 58 of the extractor, it can be employed to insert the keeper into the barrel through the muzzle end. When so used, the extractor doubles in function as an insertion tool as well as one for retrieving the keeper. Obviously, the keeper can be inserted by hand and pushed down in the barrel until it contacts the near end of the lock rod,-however, it is important that this not be done and that the extractor be used for this purpose. One reason, obviously, is that if the keeper is so far down in the barrel that the extractor cannot engage and retrieve it before shoulder 60 strikes the muzzle, it must be pushed back all the way into the cylinder to retrieve same. In any event, the extractor is screwed onto the keeper and the two elements thus assembled are inserted into the barrel until stop-forming shoulder 60 strikes the muzzle. If, perchance, the subassembly of these two elements will not go into the barrel this far, either the chamber aligned with the barrel still contains a cartridge or some other obstruction or, conceivably, the wrong lock rod is being used which is too long for the particular barrel. In either event, the user is immediately apprised that something is wrong, most likely that the gun is still loaded.

Assuming no such condition exists, the extractor/-keeper subassembly should enter the barrel until shoulder 60 engages the muzzle. A quarter of an inch or so before this occurs, however, the extractor should appear as in FIG. 4 with the head 68 of the indicator subassembly 62 seated in its recess 66 thus signifying that spring 86 has biased the indicator rod 70 into its normally-retracted position. At this point, the rear section 70R of the indicator rod will be extending all the way through the axial bore 48 of the keeper and out the rear end thereof in position to engage the front end of the lock rod which presumably at least, is both there and in proper position. What happens, for example, if the lock rod has dropped out or is shorter than necessary to reach all the way from the rear of the cylinder fowardly to reach the indicator rod. Obviously, it will not engage the latter and actuate same into its extended position shown in FIGS. 1 and 5 where the head 68 thereof has been pushed forwardly out of its recess 66. As soon as this occurs, the user known that either no lock rod is in the barrel at all in which event the cylinder remains unlocked and the gun can be fired or, alternatively, the wrong lock rod has been used which is too short to reach all the way from the rear end to the cylinder forwardly to a point where it will engage the rear end of the indicator rod 70 and extend same against the bias offered by spring 86. Note, in the latter instance the lock rod may still be long enough to extend the full length of the cylinder and into the barrel thus accomplishing its intended function but then again, it may not. In long barreled revolvers, it is even possible that a lock rod longer than the cylinder can remain housed only in the barrel kept there by the keeper which means that the gun can still be fired with the barrel obstructed. If, however, the proper length of lock rod is used and it is in place behind the keeper, none of these things can happen when the extractor/keeper subassembly is pushed home against the muzzle which, in turn, pushes the lock rod all the way to the frame behind the cylinder and, once stopped, it will engage the projecting end of the indicator rod and extend it to expose head 68 as the rear end of the keeper abuts the front end of the lock rod. The latter element might, for example, have the exposable cylindrical surface thereof colored green or some other appropriate color to indicate the cylinder is locked and the gun is disabled.

Once this safe condition is observed, the extractor can be unscrewed from the keeper and stored away from the firearm. With the keeper frictionally held in the bore against rotation, it becomes a simple matter to both connect the extractor thereto and disconnect it therefrom. When making the connection, the flared entryway 50 into the axial bore 48 through the keeper guides the indicator pin and prevents it from the interfering with the connection should it become slightly bent or sidewise misaligned.

The final dimensional relationships are such that with the keeper screwed snugly up against the rear end of the extractor as shown in both FIGS. 1 and 5, and with the indicator subassembly actuated into its extended position shown in these same two figures, the distance separating the rear end of the lock rod and stop-forming shoulder 60 on the extractor 60 must closely approximate the distance form the muzzle end of the barrel back to that forwardly-facing part of the frame containing the firing pin opening 36 and through which the firing pin 24 projects when the hammer 22 is triggered. With the extractor shoulder 60 abutting the muzzle as shown in FIG. 1, it should position the keeper in abutting relation to the lock rod with the pin extended so that the lock rod has no room to rattle around once the extractor is disconnected.

What is claimed is:

1. For use with a revolver of the type having a barrel, a multi-chambered cylinder mounted for rotation within an opening in a frame mounting the barrel and a trigger mechanism operative upon actuation to bring the cylinder chambers into axial alignment one at a time with the barrel bore, a cylinder lock assembly for preventing rotation of the cylinder which comprises: a lock rod sized to loosely fit inside the barrel bore and being of a length less than the combined lengths of said barrel and the chamber aligned therewith but greater than the length of said chamber alone; a keeper in the form of a frictionally-held plug insertable into the barrel bore and effective when so positioned to hold the lock rod therein, said keeper having a rear end proximate the ock rod, a front end carrying a first connecting means ngageable by a tool for extracting same, and an axial pening extending between the ends thereof; and an xtractor having a rear end sized for insertion into the arrel bore and a front end, second connecting means arried by said rear end releasably connectable to said irst connecting means on the front end of the keeper for lacing the latter in the barrel bore and retrieving same herefrom, said extractor also having an axial opening herethrough and a pin mounted within said opening for eciprocal movement relative thereto between an exended and a retracted position, said pin having a front nd and a rear end and an overall length greater than he combined lengths of the keeper and extractor when onnected together, said pin in retracted position with he extractor and keeper thus interconnected extending ll the way through the latter and beyond the rear end hereof into position for engagement with the near end f the lock rod when the remote end thereof is seated gainst the portion of the frame behind the cylinder fter having passed through said aligned chamber hereof, and the front end of said pin in extended posiion brought about by deeper insertion of said interconected extractor and keeper into the barrel bore with aid pin contacting the lock rod providing an observer vith a visual indication that said rod is thus seated.

2. The cylinder lock assembly as set forth in claim 1 n which: the keeper comprises a generally-cylindrical lug of a diameter less than that of the barrel bore and ncircled at longitudinally-spaced locations by annular grooves, and a pair of O-rings made of compressible lastomeric material seated within said annular grooves, he outside diameter of said O-rings when thus seated xceeding the internal diameter of the barrel bore by an mount effective to maintain said plug in any selected ixed position therein while permitting retrieval thereof y the extractor.

3. The cylinder lock assembly as set forth in claim 1 vherein: the pin has a forwardly-facing abutment and he extractor has a rearwardly-facing abutment opposng the latter inside the axial opening therein, and vherein a compression spring is interposed between said abutments normally biasing said pin into its retracted position.

4. The cylinder lock assembly as set forth in claim 1 wherein: the front end of the extractor is oversize with respect to the barrel bore and is separated from the rear end thereof by a stop-forming shoulder adapted to limit the penetration thereof, the overall length of the assembly comprising the lock rod and the interconnected subassembly consisting of the keeper and extractor with the pin inside the latter extended and in contact with the near end of said lock rod measured from the remote end of the latter to the stop-forming shoulder closely approximating the distance separating the muzzle of the barrel from the portion of the frame behind the cylinder.

5. The cylinder lock assembly as set forth in claim 1 wherein: first connecting means are provided on both the front and rear ends of the keeper.

6. The cylinder lock assembly as set forth in claim 1 wherein: at least the front end of the keeper includes a flared entryway into the axial opening therein effective to guide the extractor pin into and through the latter.

7. The cylinder lock assembly as set forth in claim 1 wherein: the first and second connecting means comprise mutually interengageable male and female threaded connections.

8. The cylinder lock assembly as set forth in claim 1 wherein: the length of the keeper is less than the length of the cylinder.

9. The cylinder lock assembly as set forth in claim 4 wherein: the front end of the extractor comprises a handle-forming portion having a forwardly-opening recess therein and wherein the front end of the pin carries a head recessed within said recess in the extractor handle when said pin is in retracted position and projecting fowardly therebeyond when the latter is extended.

10. The cylinder lock assembly as set forth in claim 9 wherein: the portion of the extractor pin head hidden within the recess therefor in the extractor when said pin is retracted in colored and becomes visible to an observer upon extension thereof.

* * * * *